US007724193B2

(12) United States Patent
Soora et al.

(10) Patent No.: US 7,724,193 B2
(45) Date of Patent: May 25, 2010

(54) PRINTED CIRCUIT BOARDS WITH A MULTI-PLANE ANTENNA AND METHODS FOR CONFIGURING THE SAME

(75) Inventors: Shruthi Soora, Raleigh, NC (US); Mete Ozkar, Raleigh, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 385 days.

(21) Appl. No.: 11/840,454

(22) Filed: Aug. 17, 2007

(65) Prior Publication Data

US 2009/0027278 A1 Jan. 29, 2009

Related U.S. Application Data

(60) Provisional application No. 60/951,603, filed on Jul. 24, 2007.

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/895, 343/702, 700 MS

See application file for complete search history.

(56) References Cited

U.S. PATENT DOCUMENTS

| | | | | |
|---|---|---|---|---|
| 5,683,788 | A | 11/1997 | Dugan et al. | |
| 6,020,562 | A | 2/2000 | Burns et al. | |
| 6,618,023 | B2 * | 9/2003 | Park | 343/895 |
| 6,774,856 | B2 | 8/2004 | Back et al. | |
| 6,825,819 | B2 * | 11/2004 | Kim et al. | 343/895 |
| 7,038,635 | B2 * | 5/2006 | Fukushima et al. | 343/895 |
| 2003/0001793 | A1 | 1/2003 | Park | |
| 2003/0030585 | A1 | 2/2003 | Lin et al. | |
| 2003/0114118 | A1 | 6/2003 | Fukushima et al. | |
| 2003/0222822 | A1 | 12/2003 | Kim et al. | |
| 2006/0256031 | A1 | 11/2006 | Bae et al. | |
| 2006/0262030 | A1 | 11/2006 | Bae et al. | |

FOREIGN PATENT DOCUMENTS

| | | |
|---|---|---|
| WO | WO 96/38874 | 12/1999 |
| WO | WO 01/17061 | 3/2001 |

OTHER PUBLICATIONS

Notification of Transmittal of the International Search Report and The Written Opinion of the International Searching Authority for PCT/US2008/001469 dated Jun. 18, 2008.

* cited by examiner

*Primary Examiner*—Hoang V Nguyen
(74) *Attorney, Agent, or Firm*—Myers Bigel Sibley & Sajovec P.A.

(57) ABSTRACT

Multi-plane antennae on a substrate having a front face and a back face are provided. A plurality of through holes extend through the substrate between the front face and the back face of the substrate. A first antenna component is on the front face of the substrate and a second antenna component is on the back face of the substrate. A conductive via extends through a selected one of the through holes that electrically connects the first antenna component and the second antenna component to define the multi-plane antenna on the substrate. The substrate may be a printed circuit board (PCB). Mobile terminals including a multi-plane antenna and methods of configuring a multi-plane antenna are also provided.

30 Claims, 15 Drawing Sheets

PRINTED CIRCUIT BOARDS WITH A MULTI-PLANE ANTENNA AND METHODS FOR CONFIGURING THE SAME

RELATED APPLICATIONS

This application claims the benefit of and priority to U.S. Provisional Patent Application No. 60/951,603, entitled "PRINTED CIRCUIT BOARDS WITH MULTI-PLANE ANTENNAS AND METHODS FOR CONFIGURING THE SAME," filed Jul. 24, 2007, the disclosure of which is hereby incorporated herein by reference as if set forth in its entirety.

BACKGROUND OF THE INVENTION

The present invention relates to the field of communications, and, more particularly, to antennas and wireless terminals incorporating the same.

The size of wireless terminals has been decreasing with, many contemporary wireless terminals being less than 11 centimeters in length. Correspondingly, there is increasing interest in small antennas that can be utilized as internally mounted antennas for wireless terminals. For example, challenges are presented for GPS, Bluetooth and the like antenna placement due to the small form factors and tight space requirements in applications such as wireless terminals.

Inverted-F planar antennas, for example, may be well suited for use within the confines of wireless terminals, particularly wireless terminals undergoing miniaturization. Typically, conventional inverted-F antennas include a conductive element that is maintained in a spaced apart relationship with a ground plane. Exemplary inverted-F antennas are described in U.S. Pat. Nos. 6,538,604 and 6,380,905, which are incorporated herein by reference in their entirety.

SUMMARY OF THE INVENTION

Some embodiments of the present invention provide a multi-plane antenna on a substrate having a front face and a back face. A plurality of through holes extend through the substrate between the front face and the back face of the substrate. A first antenna component is on the front face of the substrate and a second antenna component is on the back face of the substrate. A conductive via extends through a selected one of the through holes that electrically connects the first antenna component and the second antenna component to define the multi-plane antenna on the substrate. The substrate may be a printed circuit board (PCB).

In further embodiments, the first antenna component is a plurality of antenna components on the front face of the PCB and the second antenna component is a plurality of antenna components on the back face of the PCB. The conductive via is a plurality of conductive vias extending through selected ones of the through holes that electrically connect respective ones of the first and second antenna components to define the multi-plane antenna on the PCB. Unused conductive vias may extend through ones of the plurality of through holes that are not associated with any of the antenna components, which unused conductive vias are arranged for use with other multi-plane antenna configurations.

In other embodiments, the multi-plane antenna is a planar inverted F antenna (PIFA), a monopole antenna and/or a dipole antenna. The multi-plane antenna may be a meander antenna and/or a spiral antenna. The antenna components may be standard size components and a spacing of the through holes may correspond to the standard size. The standard size may be, for example, 0201, 0402, 0603 and/or 0804.

The antenna components may be zero ohm resistors, capacitors and/or active components. The antenna may be a 1.575 GHz GPS antenna and/or a Bluetooth antenna.

In further embodiments, the substrate includes a surface defining a third plane and the antenna further includes a further plurality of through holes extending from the front and/or back face of the substrate to the third plane, a third antenna component on the third plane and a conductive via extending through a selected one of the further plurality of through holes that electrically connects the first and/or second antenna component to the third antenna component to define the multi-plane antenna on the substrate. The first antenna component and/or the second antenna component may be a trace pattern on the substrate and the antenna may further include additional trace patterns on the front and/or back face of the substrate extending between ones of the plurality of through holes that have no conductive vias extending therethrough. The additional trace patterns are not used to define the multi-plane antenna.

In other embodiments, the multi-plane antenna has a total antenna element length that is less than a total antenna length of a comparable performance single plane antenna. The antenna may further include a ground plane on the front or back face of the substrate that is positioned proximate the multi-plane antenna. A mobile terminal including a multi-plane antenna of one or more of the embodiments described above further includes a wireless communication circuit formed on the front and/or back face of the PCB.

In yet other embodiments, mobile terminals are provided including a portable housing and a printed circuit board (PCB) mounted in the housing. The PCB includes a plurality of through holes extending through the PCB between a front face and a back face of the PCB. A wireless communication circuit is formed on the front face and/or the back face of the PCB. A multi-plane antenna in the housing is operatively coupled to a receiver and/or transmitter of the wireless communication circuit. The multi-plane antenna includes a first antenna component on the front face of the PCB and a second antenna component on the back face of the PCB. A conductive via extends through a selected one of the through holes and electrically connects the first antenna component and the second antenna component to define the multi-plane antenna on the PCB.

In other embodiments, a plurality of antenna components are provided on the front and back face of the PCB and a plurality of conductive vias extending through selected ones of the through holes electrically connect respective ones of the first and second antenna components to define the multi-plane antenna on the PCB. Unused conductive vias may extend through ones of the plurality of through holes that are not associated with any of the antenna components, which unused conductive vias are arranged for use with other multi-plane antenna configurations.

In further embodiments methods for configuring a multi-plane antenna include providing a substrate having a front face and a back face, a plurality of through holes extending through the substrate from the front face to the back face at selected locations on the substrate and conductive vias extending through the plurality of through holes. A plurality of antenna components are selected. Either the front face or the back face is selected for mounting each of the selected plurality of antenna components. Pairs of the conductive vias to be associated with respective ones of the antenna components are selected. The respective ones of the antenna components are electrically connected between the corresponding pairs of conductive vias on the corresponding selected face of the substrate to form the multi-plane antenna.

In other embodiments, providing the substrate includes forming the plurality of through holes extending through the substrate from the front face to the back face at the selected locations on the substrate and forming conductive vias extending through the plurality of through holes. Selecting either the front face or the back face may include selecting the front face for a portion of the plurality of antenna components and selecting the back face for a remainder of the plurality of antenna components.

DETAILED DESCRIPTION OF THE INVENTION

Figure 1A:
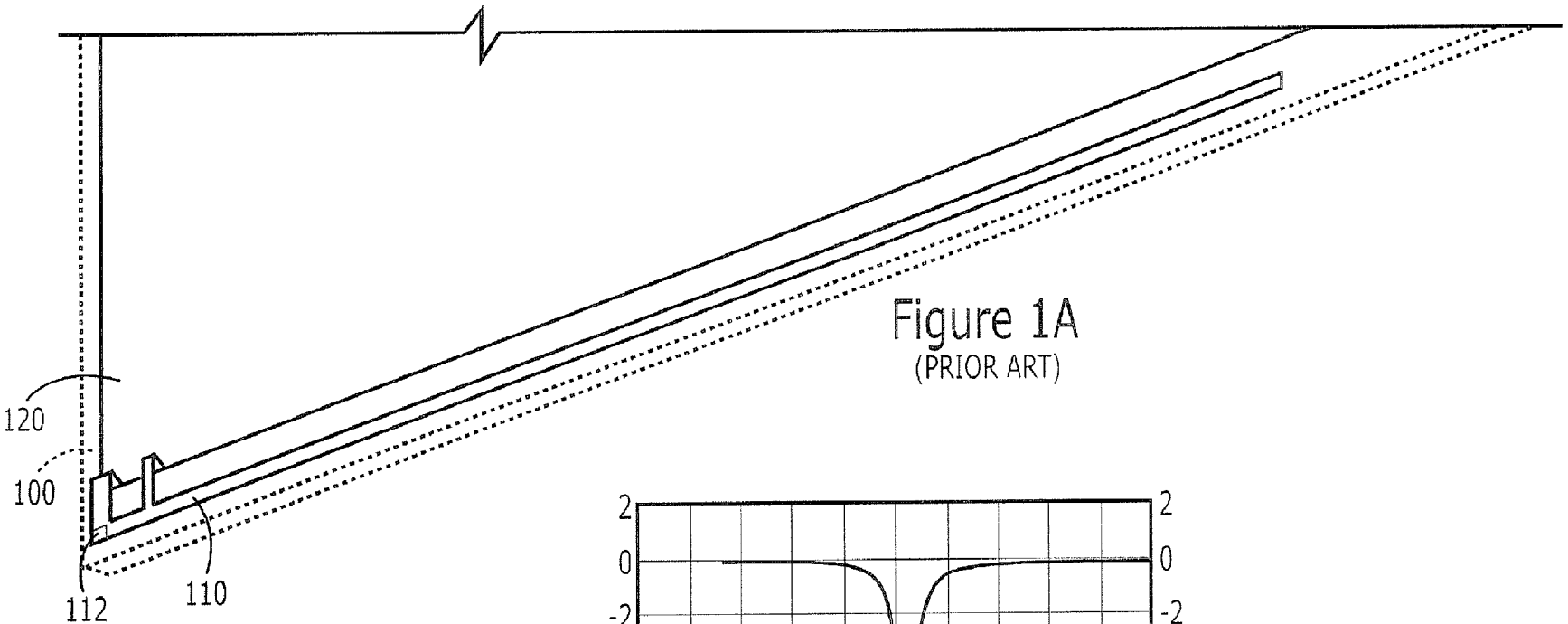
Figure 1A (PRIOR ART)
FIG. 1A illustrates a conventional 1 layer PIFA.

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that, although the terms first, second, etc. may be used herein to describe various elements, these elements should not be limited by these terms. These terms are only used to distinguish one element from another.

Unless otherwise defined, all teens (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

As will be further described herein, some embodiments of the present invention implement planar inverted F antennae (PIFA), monopole antennae, dipole antennae and/or the like on a printed circuit board (PCB). In some embodiments, via holes are used to make use of at least two layers/planes (bottom and top) on the PCB to gain antenna length by using the PCB thickness. In some embodiments, standard sized components, such as 0201, 0402 or the like (such as zero ohm resistors) can be placed in between the via holes to tune the length of an antenna without the need for another board spin. As such, in some embodiments, components can be added and/or removed after production of the PCB to, for example, fine tune the antenna and/or even change the complete design of the antenna without having to re-spin the PCB.

In some embodiments, in addition to the meander line design, other geometric shapes (such as a helical antenna) are implemented on the PCB. This way of implementation may be used, for example, for Bluetooth and/or GPS antennae in wireless terminals.

Various embodiments of the present invention will now be described with reference to the attached figures. For purposes of explanation of the present invention, the illustrated embodiments are based on a two layer board. For simulation purposes, a Zealand IE3D electromagnetic 2.5 D simulator is used, assuming a dielectric thickness of 0.5 mm, a dielectric constant of 4.5, a loss tangent of 0.015 and a ground plane size of 50 mm×100 mm. The PCB is assumed to have a thickness of 0.5 mm. In addition, for purposes of all of the illustrated examples, a 1.575 GHz GPS antenna is simulated. However, it will be understood that different antenna designs, different numbers of layers/planes, different PCB sizes and the like may be provided by some embodiments of the present invention and the present invention is not to be limited to the particular exemplary embodiments illustrated herein for purposes of explanation of the present invention.

Figure 1B:
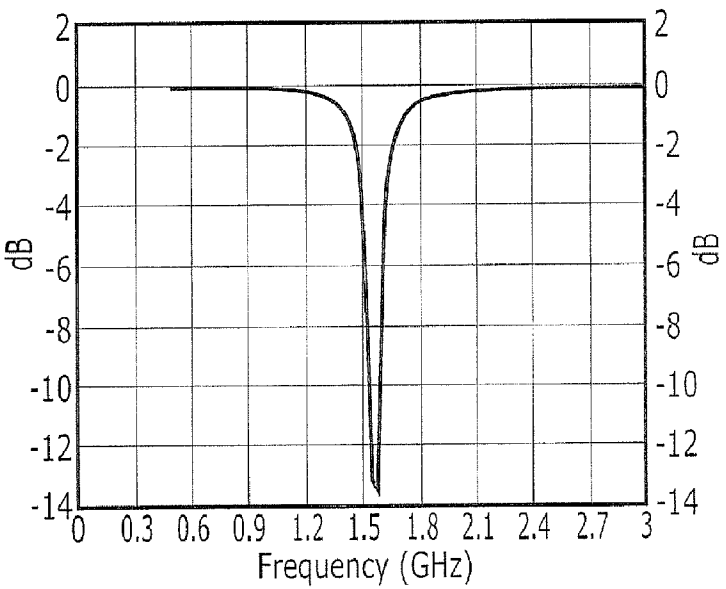
FIG. 1B is a graphical illustration of simulated performance of the antenna of FIG. 1A.

FIGS. 1A and 1B illustrate a PCB 100 having a conventional 1 layer PIFA 110 with an end-to end length of 33 mm and a width of 2 mm. The PIFA 110 leftmost end as seen in FIG. 1 includes a ground (GND) connection point 112 and is shown overlapping but insulated from the ground plane 120 at a signal feed point.

Figure 2A:
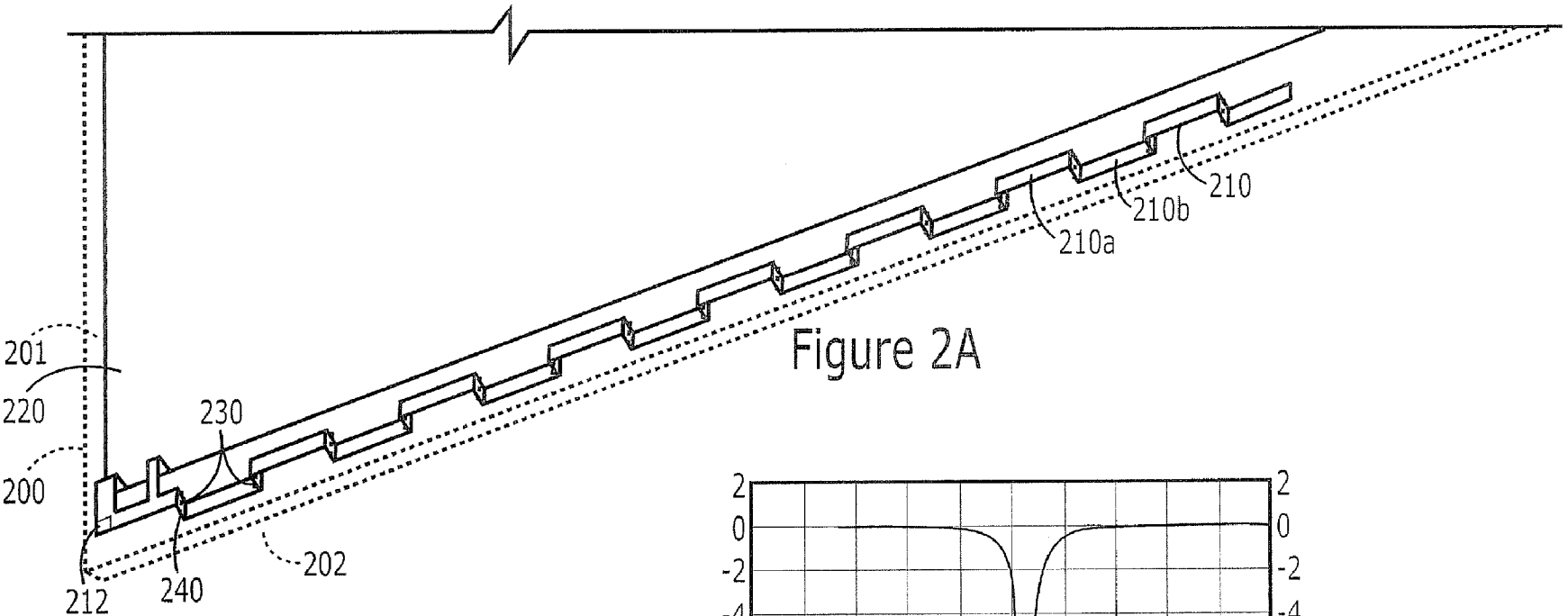
FIG. 2A illustrates a multi-layer PIFA with vias according to some embodiments of the present invention.
Figure 2B:
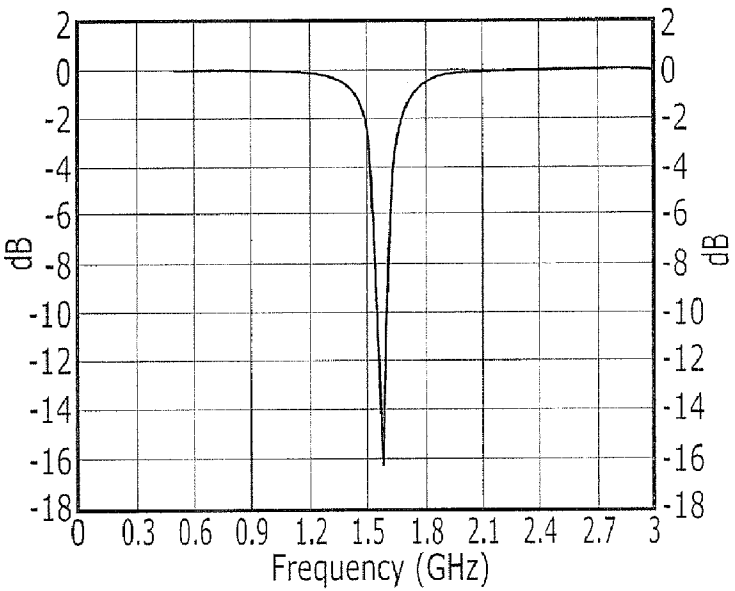
FIG. 2B is a graphical illustration of simulated performance of the antenna of FIG. 2A.

A two layer/plane PIFA 210 with vias according to some embodiments of the present invention is shown in FIGS. 2A and 2B. Note that, for the same application of a GPS antenna as seen in FIGS. 1A and 1B, the embodiments of FIGS. 2A-2B have an end-to-end length (not including the vias that extend the effective length of the antenna) of 32 mm. A PCB thickness of 0.5 mm is used for the illustrated embodiments of FIGS. 2A-2B.

Referring to FIG. 2A, the multi-plane antenna 210 is formed on a substrate, shown as a PCB 200 in the embodiments of FIG. 2A. The PCB 200 has a front face 201 and a back face 202. Note that, for purposes of illustration, the PCB 200, 300, 400, 500, 600 is shown in dotted line in FIGS. 2A-6A merely by way of reference to aid in understanding of the location of the front and back side antenna components as will now be described. Also, like numbered elements (e.g., 200, 300, 400, 500, 600) across FIGS. 2A-6A are substantially the same except as particularly described herein. The antenna 210 includes antenna components 210*a* on the front face 201 and antenna components 210*b* on the back face 202. A ground point 212 is also illustrated for the antenna 210 and a ground plane 220 is shown proximate the antenna 210.

The PCB 200 further includes a plurality of through holes 230 extending through the PCB 200 between the front face 201 and the back face 202. Conductive vias 240 extend through selected ones of the through holes 230 to connect the antenna components 210*a*, 210*b* in a pattern to define the multi-plane antenna 210 on the PCB 200. In some embodiments, the segment length between vias 240 may be selected to correspond to a standard component size, such as 0201, 0402, 0603, 0804 and/or the like, to allow ready configuration/re-configuration using readily available standard sized components, such as 0 ohm resistors and/or capacitors. Likewise, active components, such as switches, may be used, for example, to implement a multi-band antenna. Thus, while single band antennae will be described herein for illustrative purposes, multi-band antennae may also be provided and, in some embodiments, conventional approaches to providing a multi-band antenna may be more readily implemented using a multi-layer/plane antenna on a PCB as described herein.

Figure 3A:
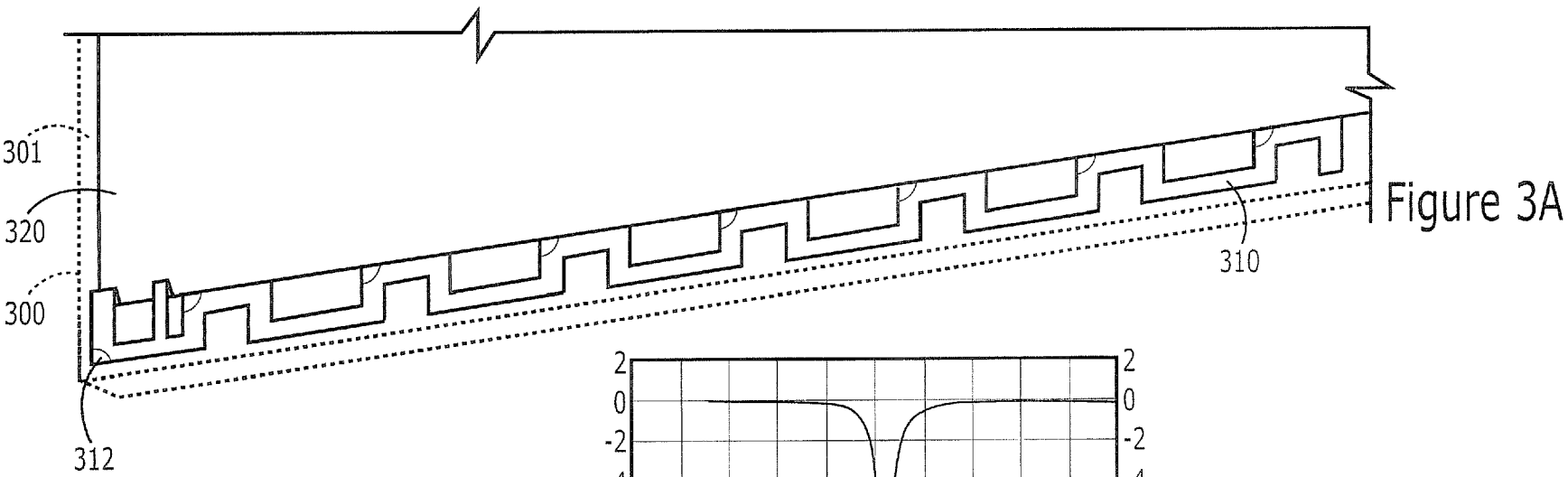
FIG. 3A illustrates a conventional meander antenna.
Figure 3B:
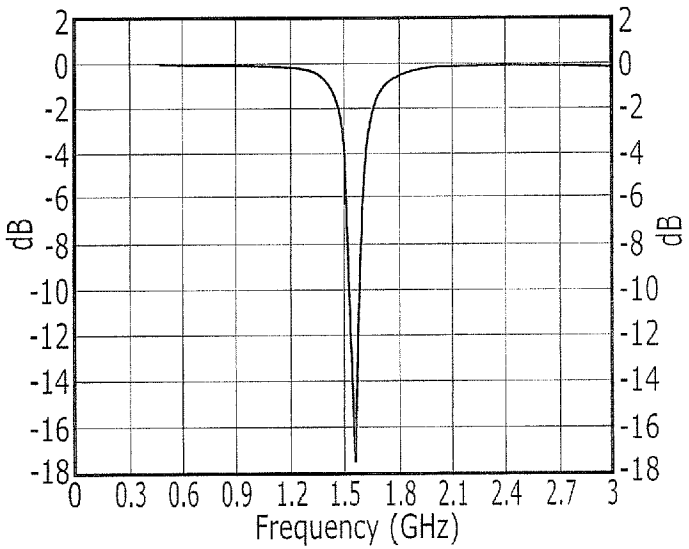
FIG. 3B is a graphical illustration of simulated performance of the antenna of FIG. 3A.

FIGS. 3A-3B illustrate a conventional 1-layer meander layout antenna 310 on a PCB 300, wherein the end-to-end length is reduced to 28 mm from the 33 mm of the example of FIG. 1A. Also shown in FIG. 3A are a ground point 312 and a ground plane 320.

Figure 4A:
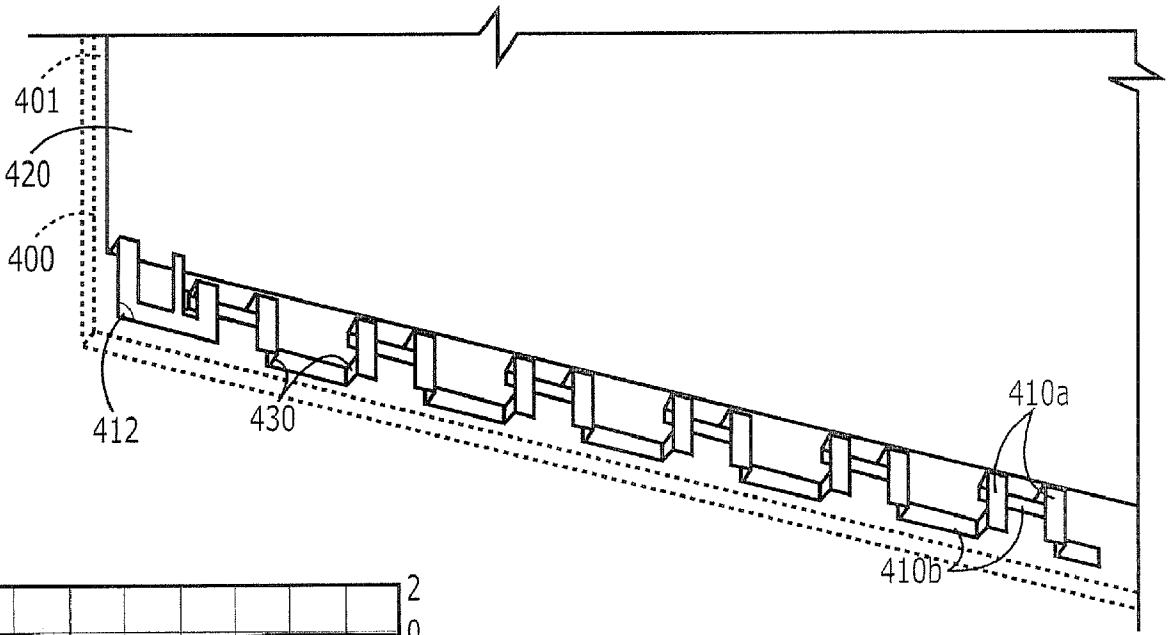
FIG. 4A illustrates a multi-layer meander antenna with vias according to some embodiments of the present invention.
Figure 4B:
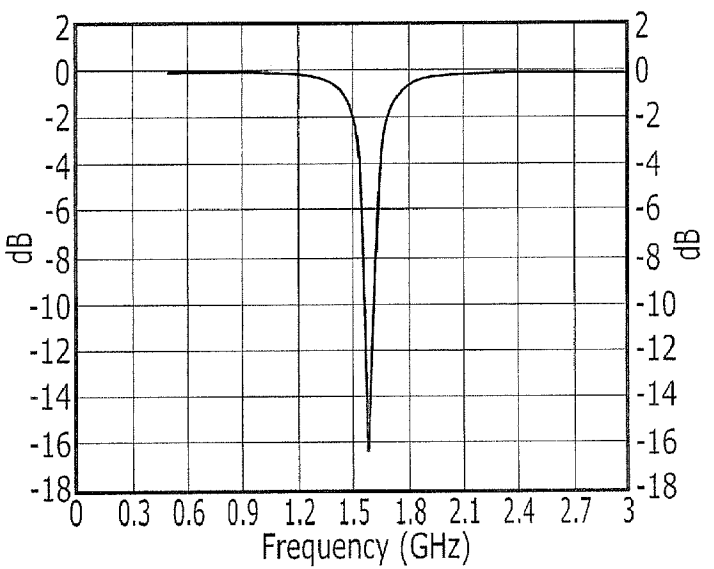
FIG. 4B is a graphical illustration of simulated performance of the antenna of FIG. 4A.

FIGS. 4*a* and 4B illustrate a multi-layer/plane meander layout antenna 410 using vias according to some embodiments of the present invention, shown as a two layer design on a 0.5 mm PCB 400 in FIG. 4A. The embodiments of the antenna 410 of FIG. 4A have an end-to-end length of 25 mm.

Referring to FIG. 4A, the multi-plane antenna 410 is formed on a substrate, shown as a PCB 400 in the embodiments of FIG. 4A. The PCB 400 has a front face 401 and a back face 402. The antenna 410 includes antenna components 410*a* on the front face 401 and antenna components 410*b* on the back face 402. A ground point 412 is also illustrated for the antenna 410 and a ground plane 420 is shown proximate the antenna 410.

The PCB 400 further includes a plurality of through holes 430 extending through the PCB 400 between the front face 401 and the back face 402. Conductive vias 440 extend through selected ones of the through holes 430 to connect the antenna components 410*a*, 410*b* in a pattern to define the multi-plane antenna 410 on the PCB 400. The antenna 410 of FIG. 4A, as contrasted with the multi-plane PIFA 210 of FIG. 2A is a meander antenna design, illustrating the flexibility provided by some embodiments of the present invention.

Figure 5A:
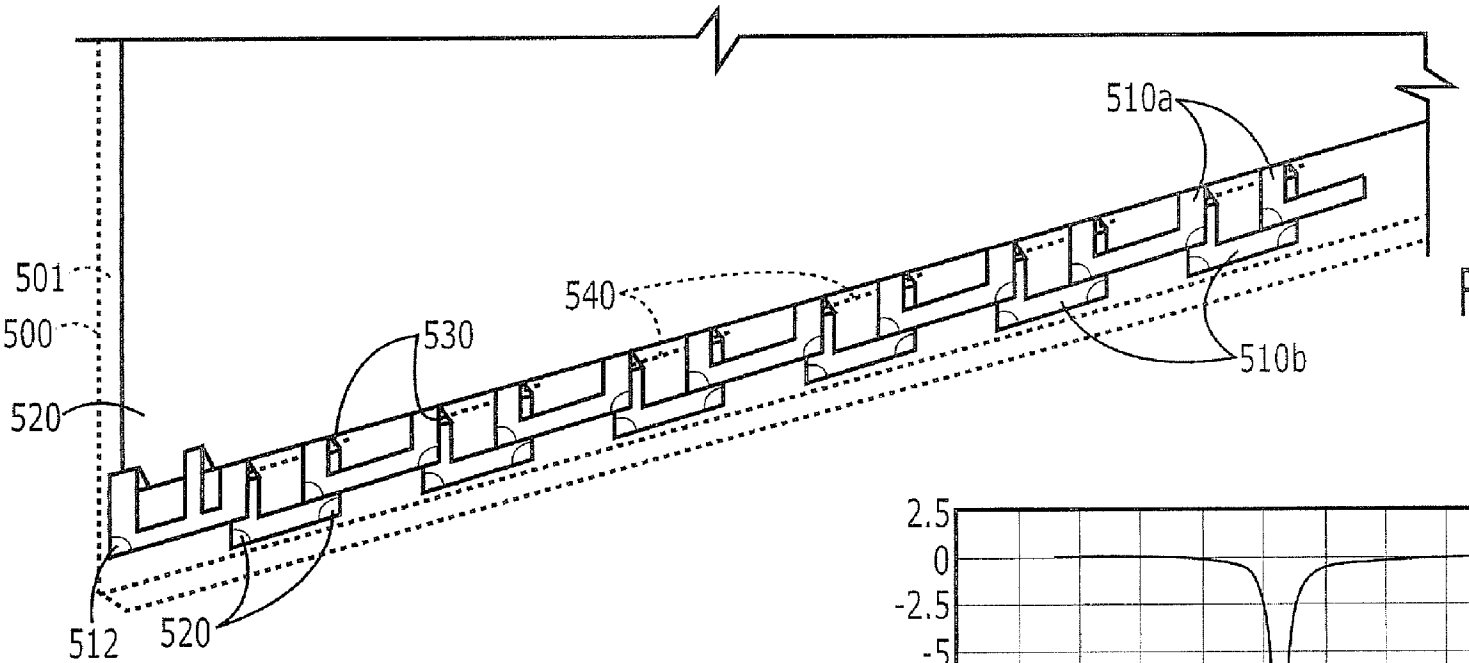
FIG. 5A illustrates a multi-layer meander antenna with vias according to some embodiments of the present invention.
Figure 5B:
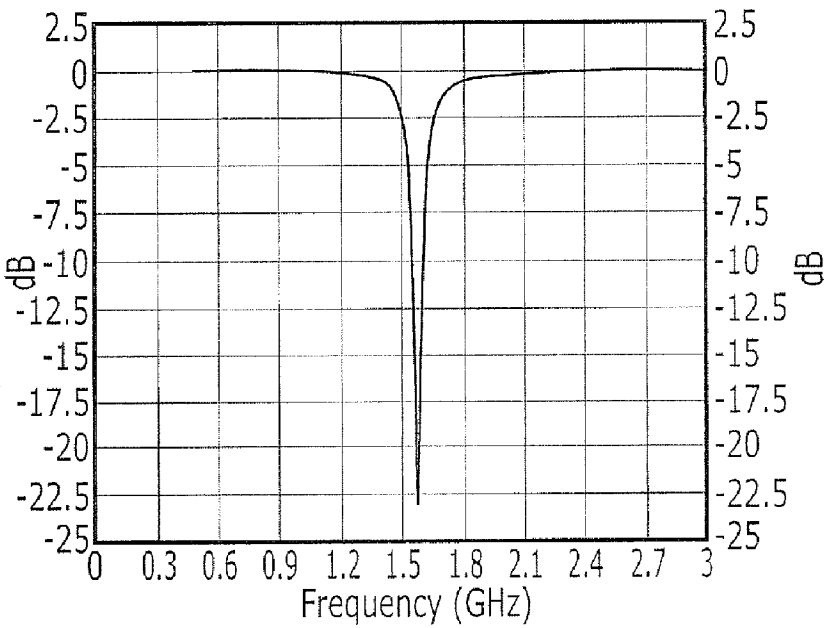
FIG. 5B is a graphical illustration of simulated performance of the antenna of FIG. 5A.

FIGS. 5A and 5B illustrate a further multi-layer/plane meander layout antenna 510 using vias according to some embodiments, shown as a two layer design on a 0.5 mm PCB 400 in FIG. 5A. The embodiments of the antenna 510 of FIG. 5A have an end-to-end length of 23 mm.

Referring to FIG. 5A, the multi-plane antenna 510 is formed on a substrate, shown as a PCB 500 in the embodiments of FIG. 5A. The PCB 500 has a front face 501 and a back face 502. The antenna 510 includes antenna components 510*a* on the front face 501 and antenna components 510*b* on the back face 502. A ground point 512 is also illustrated for the antenna 510 and a ground plane 520 is shown proximate the antenna 510.

The PCB 500 further includes a plurality of through holes 530 extending through the PCB 500 between the front face 501 and the back face 502. Conductive vias 540 extend through selected ones of the through holes 530 to connect the antenna components 510*a*, 510*b* in a pattern to define the multi-plane antenna 510 on the PCB 500. The antenna 510 of FIG. 5A is a variation on the configuration of FIG. 4A but is likewise, as contrasted with the multi-plane PIFA 210 of FIG. 2A, a meander antenna design.

Figure 6A:
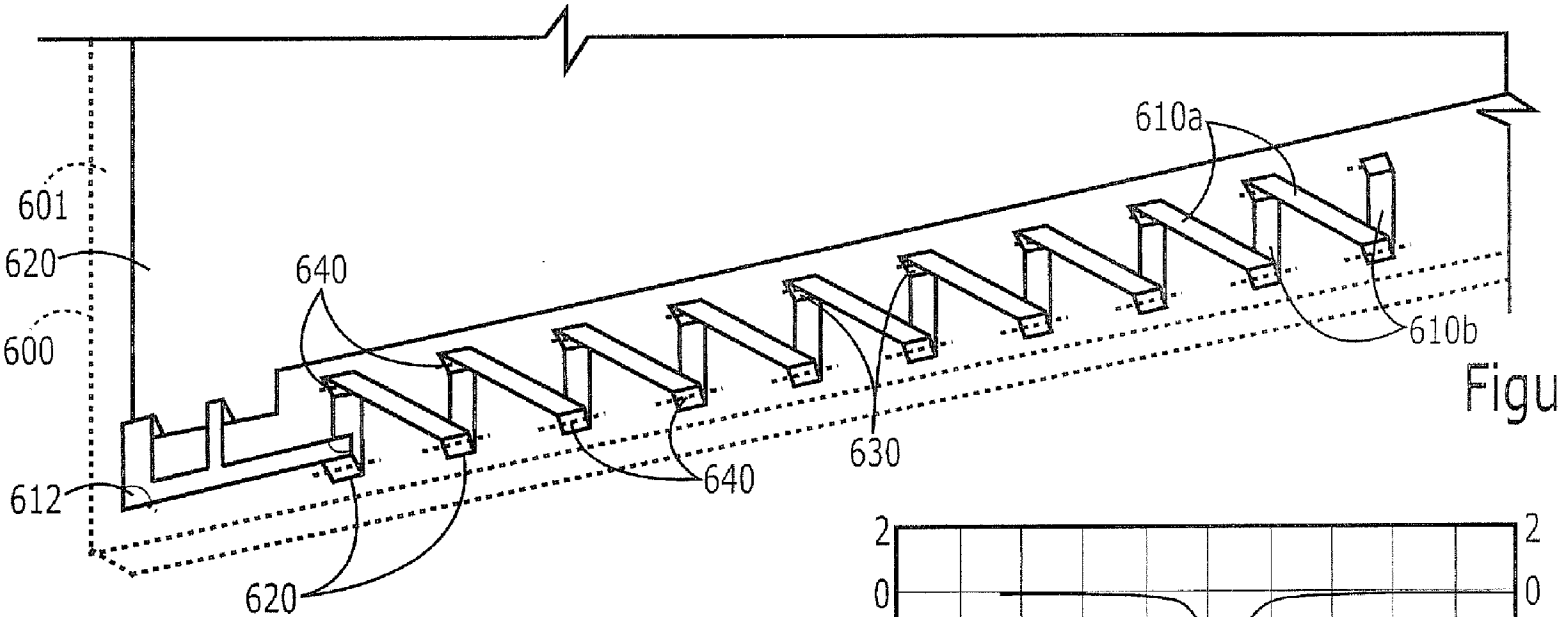
FIG. 6A illustrates a multi-layer spiral antenna with vias according to some embodiments of the present invention.
Figure 6B:
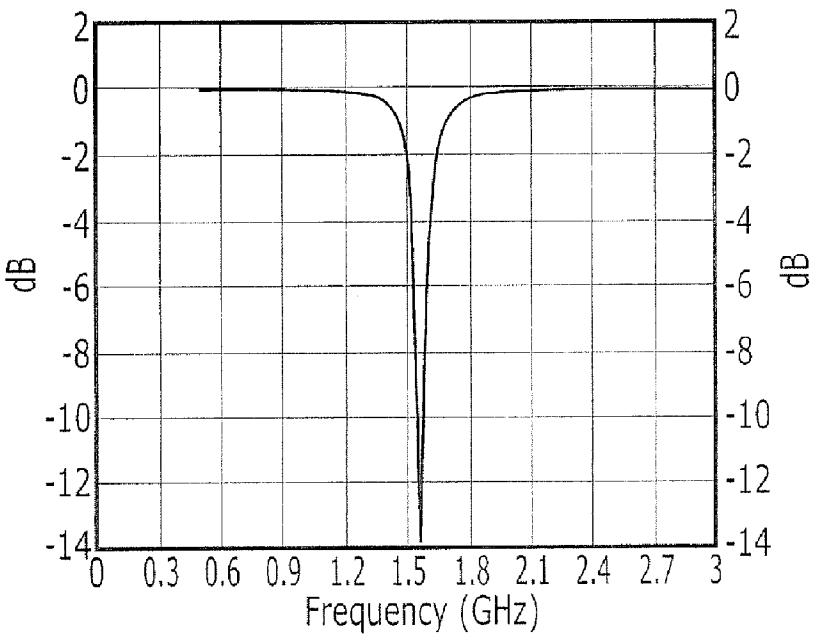
FIG. 6B is a graphical illustration of simulated performance of the antenna of FIG. 6A.

FIGS. 6A and 6B illustrate a spiral (helical) antenna 610 implemented using vias according to some embodiments of the present invention. Thus, some embodiments of the present invention may replace an antenna type normally implemented using a wire, rather than planar surfaces of a PCB, with a multi-plane antenna, shown as two planes in the embodiments of FIG. 6A.

Referring to FIG. 5A, the multi-plane antenna 610 is formed on a substrate, shown as a PCB 600 in the embodiments of FIG. 6A. The PCB 600 has a front face 601 and a back face 602. The antenna 610 includes antenna components 610*a* on the front face 601 and antenna components 610*b* on the back face 602. A ground point 612 is also illustrated for the antenna 610 and a ground plane 620 is shown proximate the antenna 610.

The PCB 600 further includes a plurality of through holes 630 extending through the PCB 600 between the front face 601 and the back face 602. Conductive vias 640 extend through selected ones of the through holes 630 to connect the antenna components 610*a*, 610*b* in a pattern to define the multi-plane antenna 610 on the PCB 600.

Figure 7:
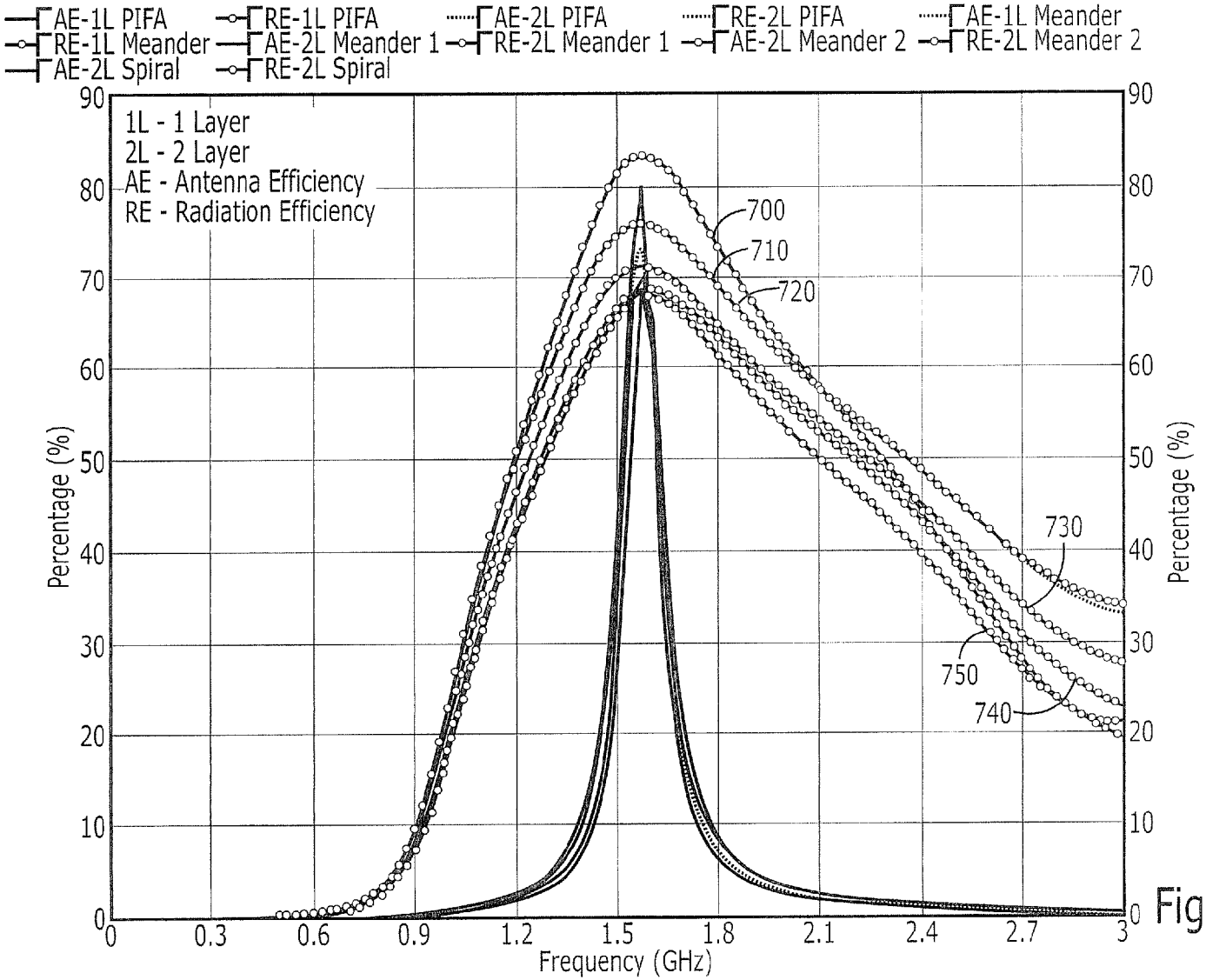
FIG. 7 is a graphical illustration of simulated antenna efficiency and radiation efficiency for the antennae of FIGS. 1A-6A.

Simulation results showing antenna efficiency (AE) and radiation efficiency (RE) for the respective antennae of FIGS. 1A-6A are shown in FIG. 7. For example, the simulation of the spiral using vias of FIG. 6A for RE is indicated by reference number 700. Also shown are the RE for the traditional PIFA of FIG. 1A (710), the two layer PIFA of FIG. 2A (720), the traditional 1-layer meander of FIG. 3A (730), the two-layer meander of FIG. 4A (740) and the two-layer meander of FIG. 5A (750).

Figure 8A:
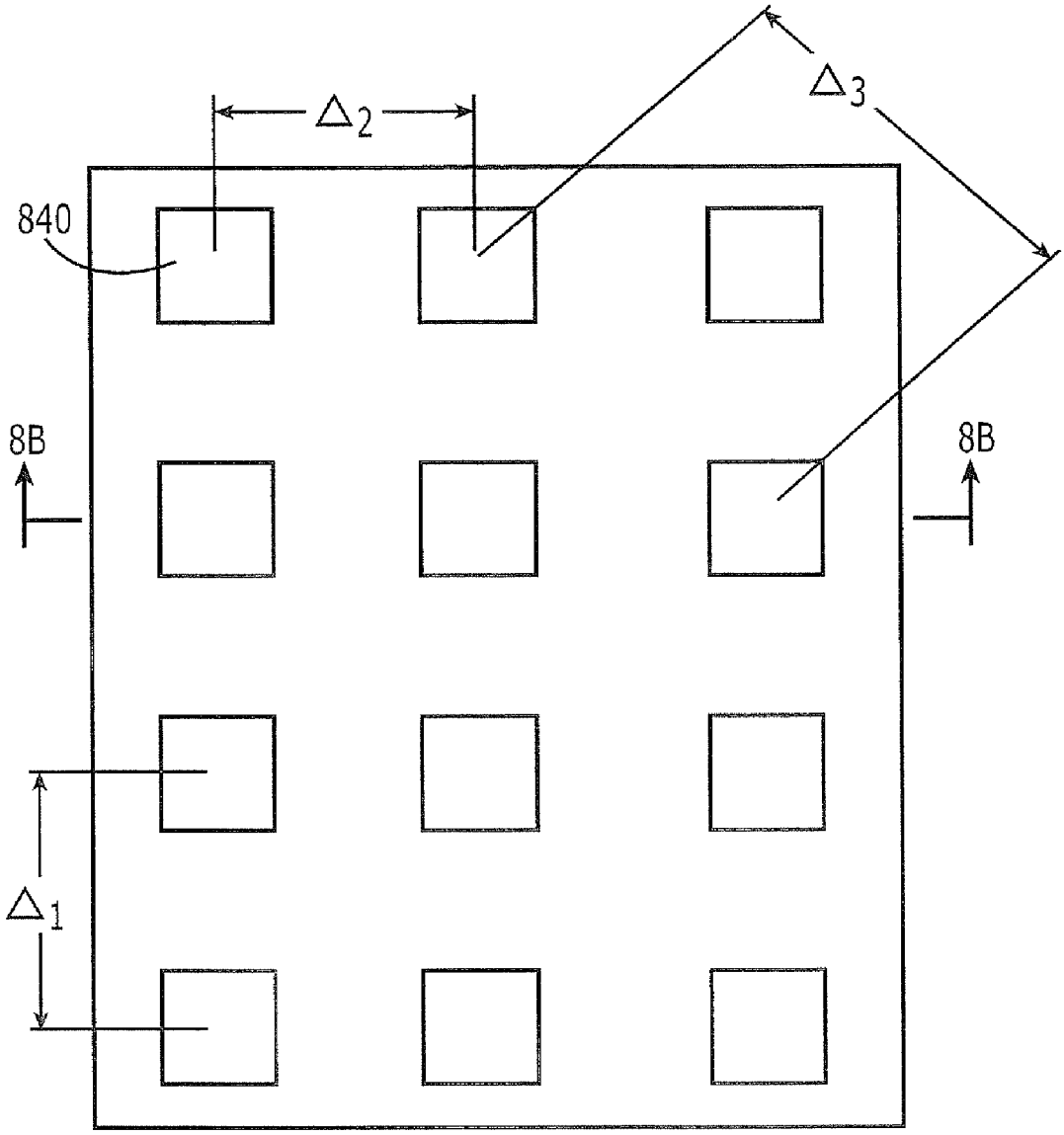
FIG. 8A is a top plane view of a PCB with vias according to some embodiments of the present invention.
Figure 8B:
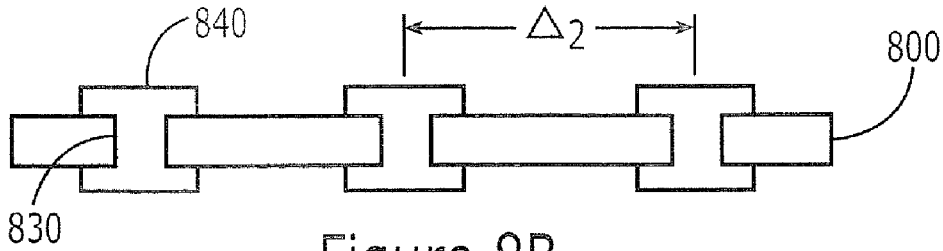
FIG. 8B is a side view of the PCB of FIG. 8A taken along line 8B-8B of FIG. 8A.

Further embodiments of the present invention will be described with reference to FIGS. 8A-11C. More particularly, FIGS. 8A and 8B show a PCB design with no components added while FIGS. 9A-11C illustrate three different exemplary implementations created using the common board footprint of FIGS. 8A and 8B. As seen in FIG. 8A, the substrate, shown as a PCB 800, includes a plurality of conductive vias 840 in a 3×4 matrix. It will be understood that, while illustrated as a 3×4 matrix of vias in a uniform grid in FIG. 8A, the present invention is not limited to such a configuration and may use different arrangements and spacing of vias. As seen in FIG. 5B, the conductive vias 840 extend through respective through holes 830 that extend from the front face (shown in FIG. 8A) to the opposite, back face of the PCB 800.

The respective conductive vias 840 are arranged with a longitudinal spacing $\Delta_1$, a lateral spacing $\Delta_2$ and a cross spacing $\Delta_3$. While the longitudinal spacing $\Delta_1$ and the lateral spacing $\Delta_2$ are shown as equal in FIG. 8A, varied spacing may be provided in some embodiments, not only lateral relative to longitudinal but within rows and/or columns of the arrangement of conductive vias. The via spacing in some embodiments is selected to provide for use of standard size components.

Figure 9A:
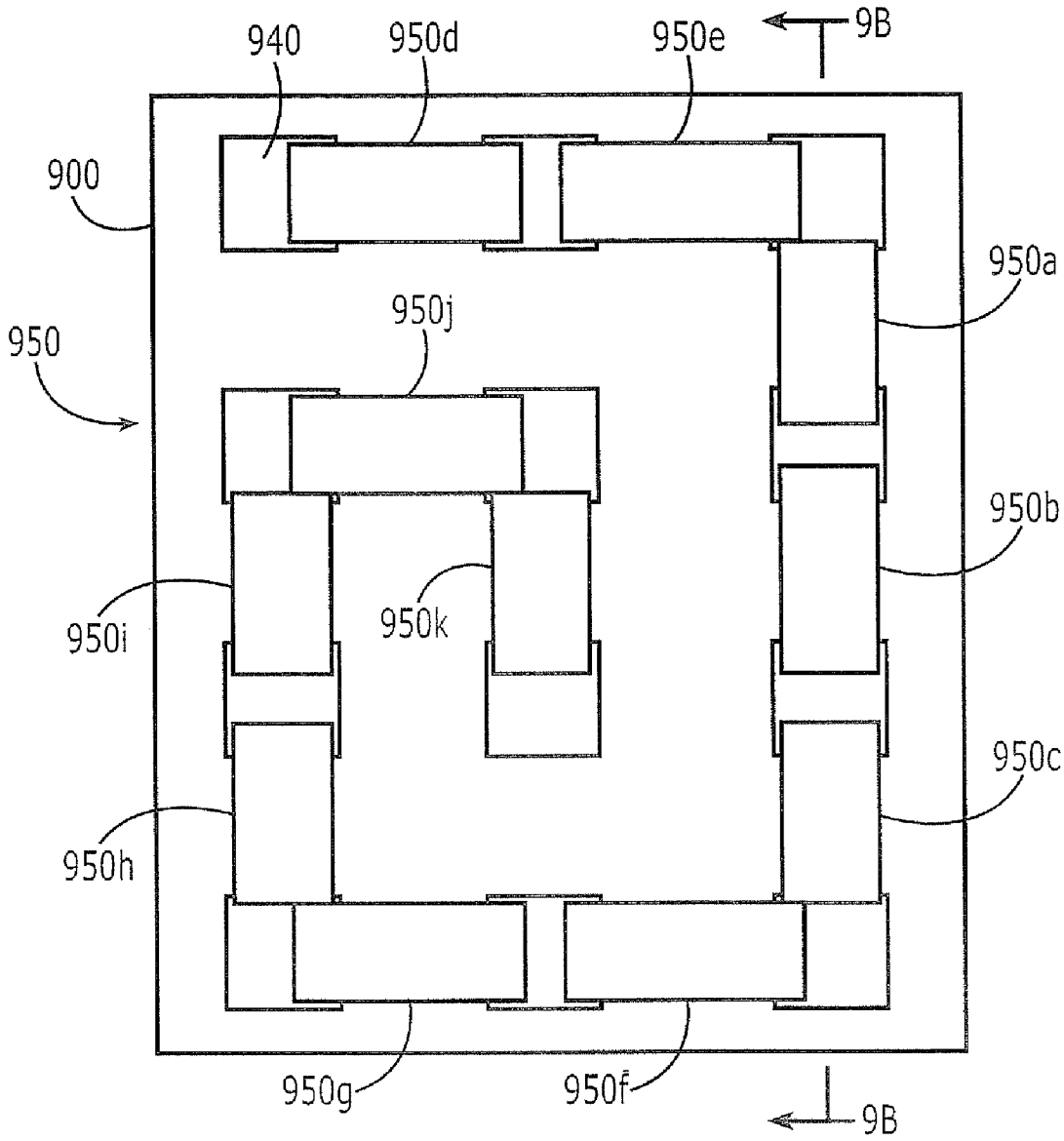
FIG. 9A is a top plane view of a multi-plane antenna on the PCB with vias of FIGS. 8A-8B according to some embodiments of the present invention.
Figure 9B:
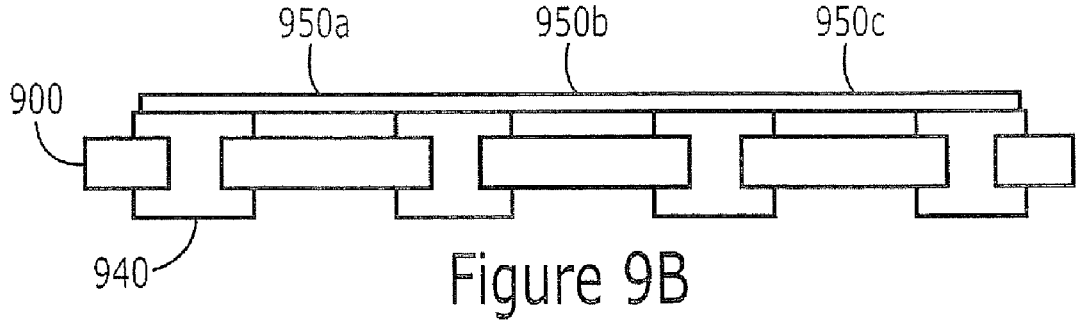
FIG. 9B is a side view of the antenna of FIG. 9A taken along line 9B-9B of FIG. 9A.
Figure 9C:
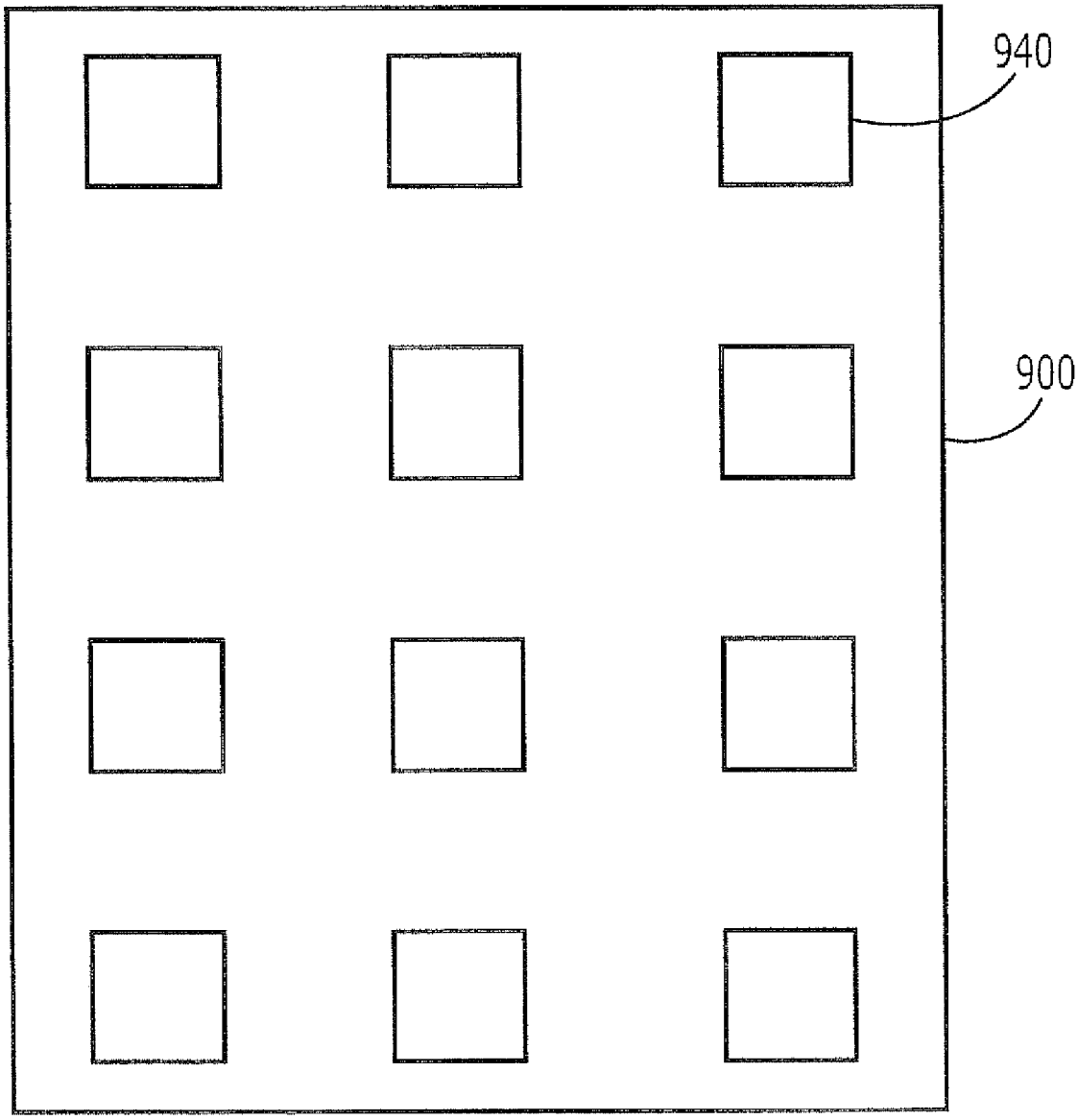
FIG. 9C is a bottom plane view of the antenna of FIG. 9A.

As seen in FIGS. 9A-9C, in some embodiments, using the design flexibility provided by vias, all the components may be placed on a single side. As seen in FIGS. 9A-9C, a substrate, shown as a PCB 900, includes a plurality of conductive vias 940 extending therethrough from a front face (FIG. 9A) to a back face (FIG. 9B) of the PCB 900. An antenna 950 is formed by a plurality of antenna components 950*a*-950*k* electrically connected at respective ones of the conductive vias 950.

Figure 10A:
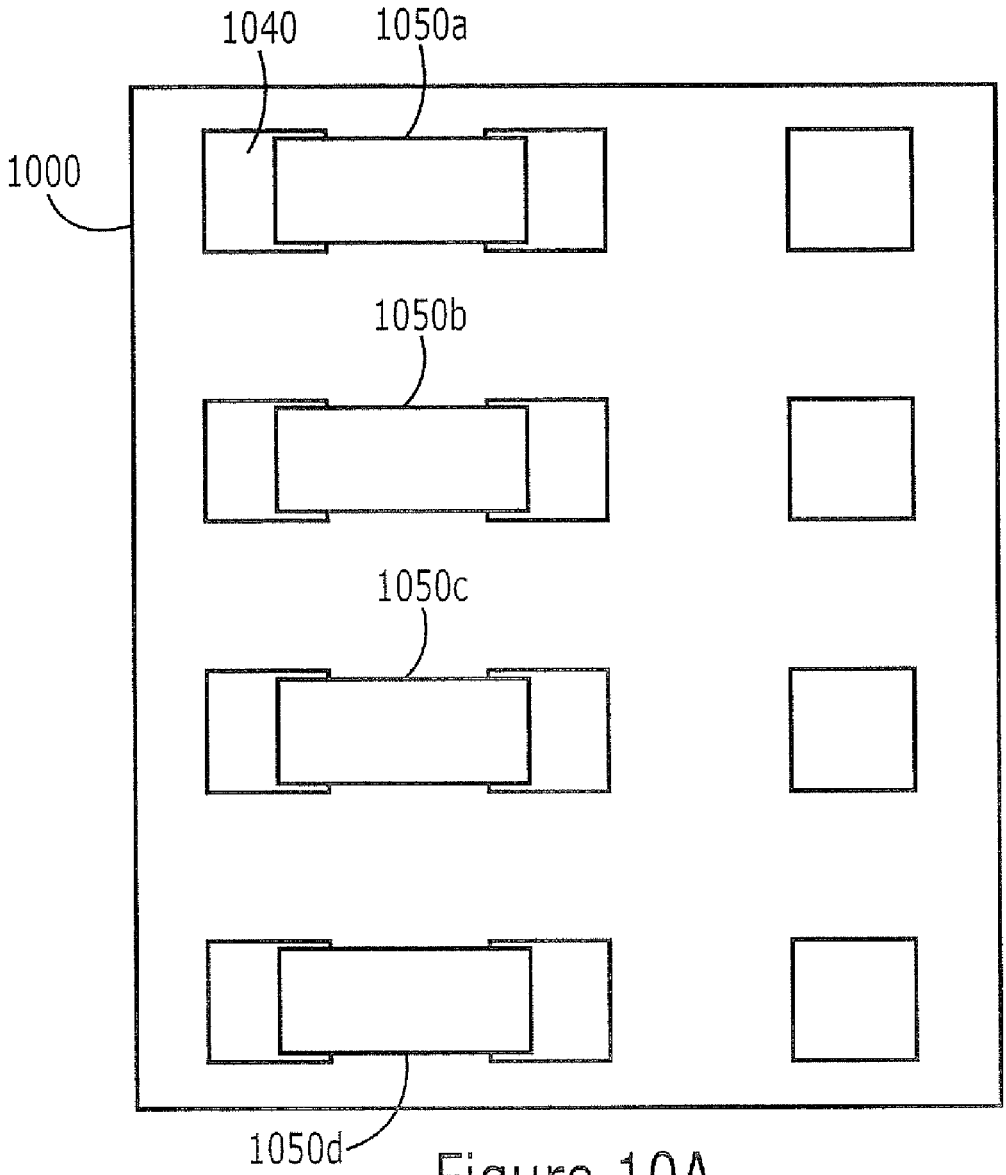
FIG. 10A is a top plane view of a further multi-plane antenna on the PCB with vias of FIGS. 5A-8B according to some embodiments of the present invention.
Figure 10B:
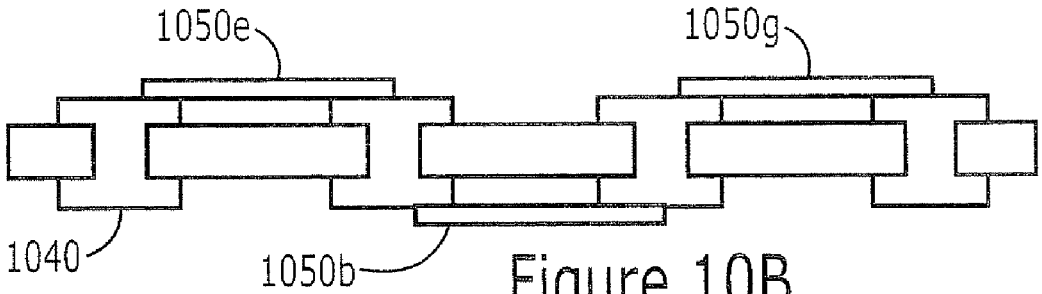
FIG. 10B is a side view of the antenna of FIG. 10A taken along line 10B-10B of FIG. 10C.
Figure 10C:
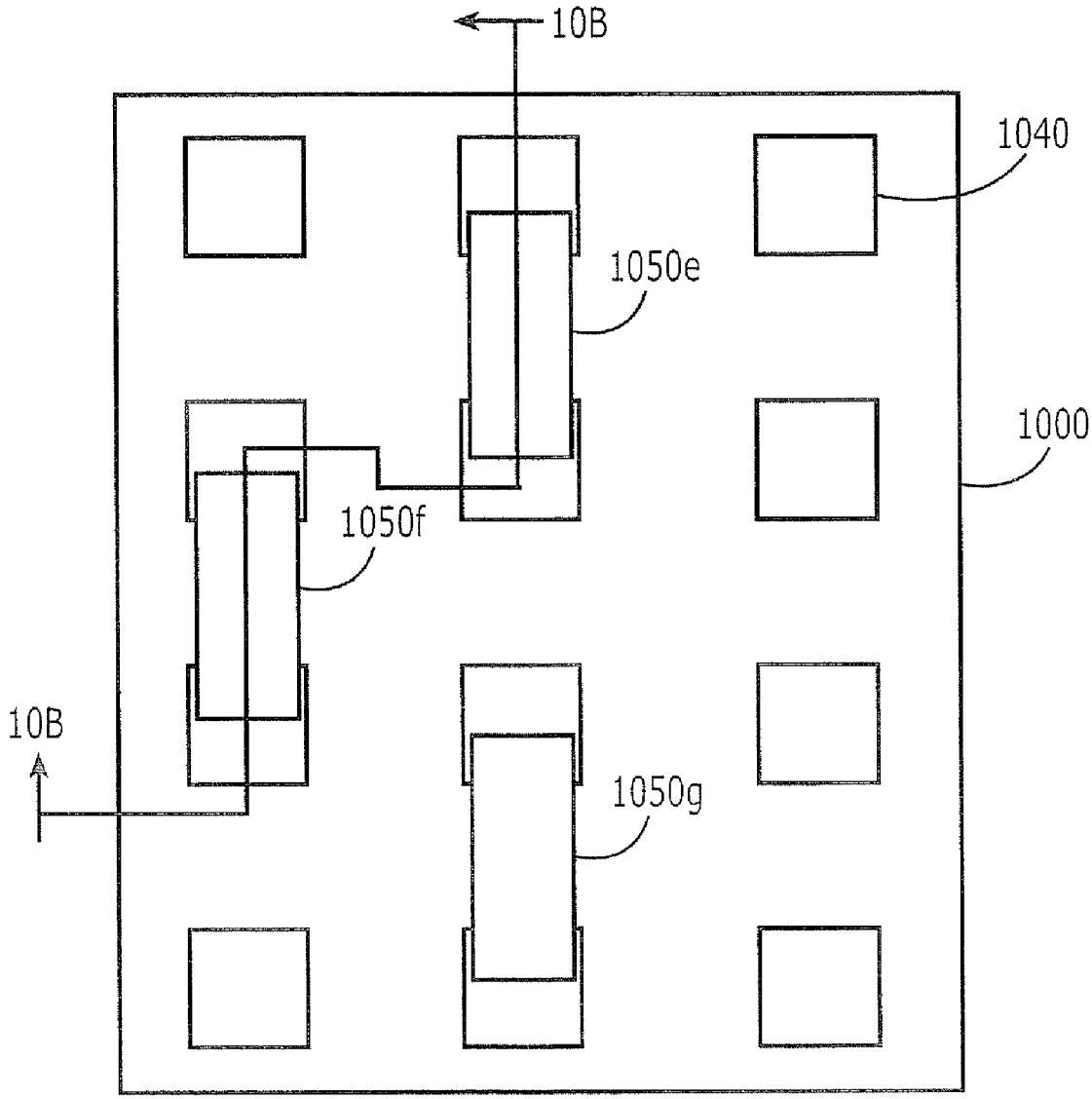
FIG. 10C is a bottom plane view of the antenna of FIG. 10A.

FIGS. 10A-10C show a meander design implementation according to some embodiments of the present invention. As seen in FIGS. 10A-10C, a substrate, shown as a PCB 1000, includes a plurality of conductive vias 1040 extending therethrough from a front face (FIG. 10A) to a back face (FIG. 10B) of the PCB 1000. An antenna 1050 is formed by a plurality of antenna components 1050*a*-1050*g* electrically connected between respective ones of the conductive vias 1050 and through the conductive vias 1050 to respective components on opposite faces of the PCB 1000.

Figure 11A:
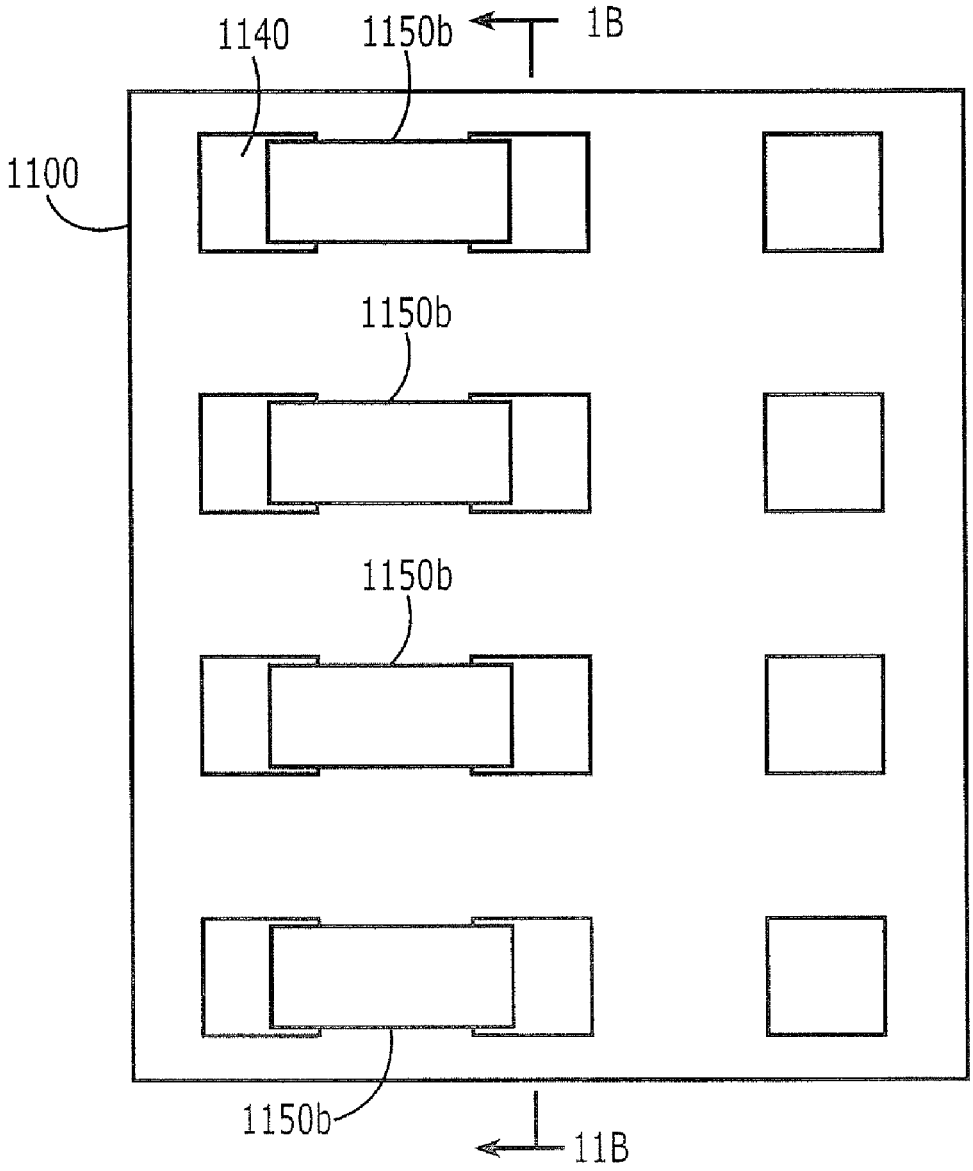
FIG. 11A is a top plane view of another multi-plane antenna on the PCB with vias of FIGS. 8A-8B according to some embodiments of the present invention.
Figure 11B:
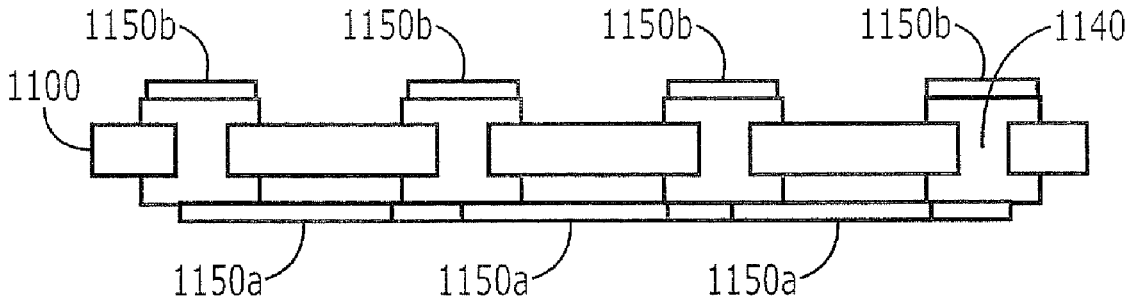
FIG. 11B is a side view of the antenna of FIG. 11A taken along line 11B-11B of FIG. 11A.
Figure 11C:
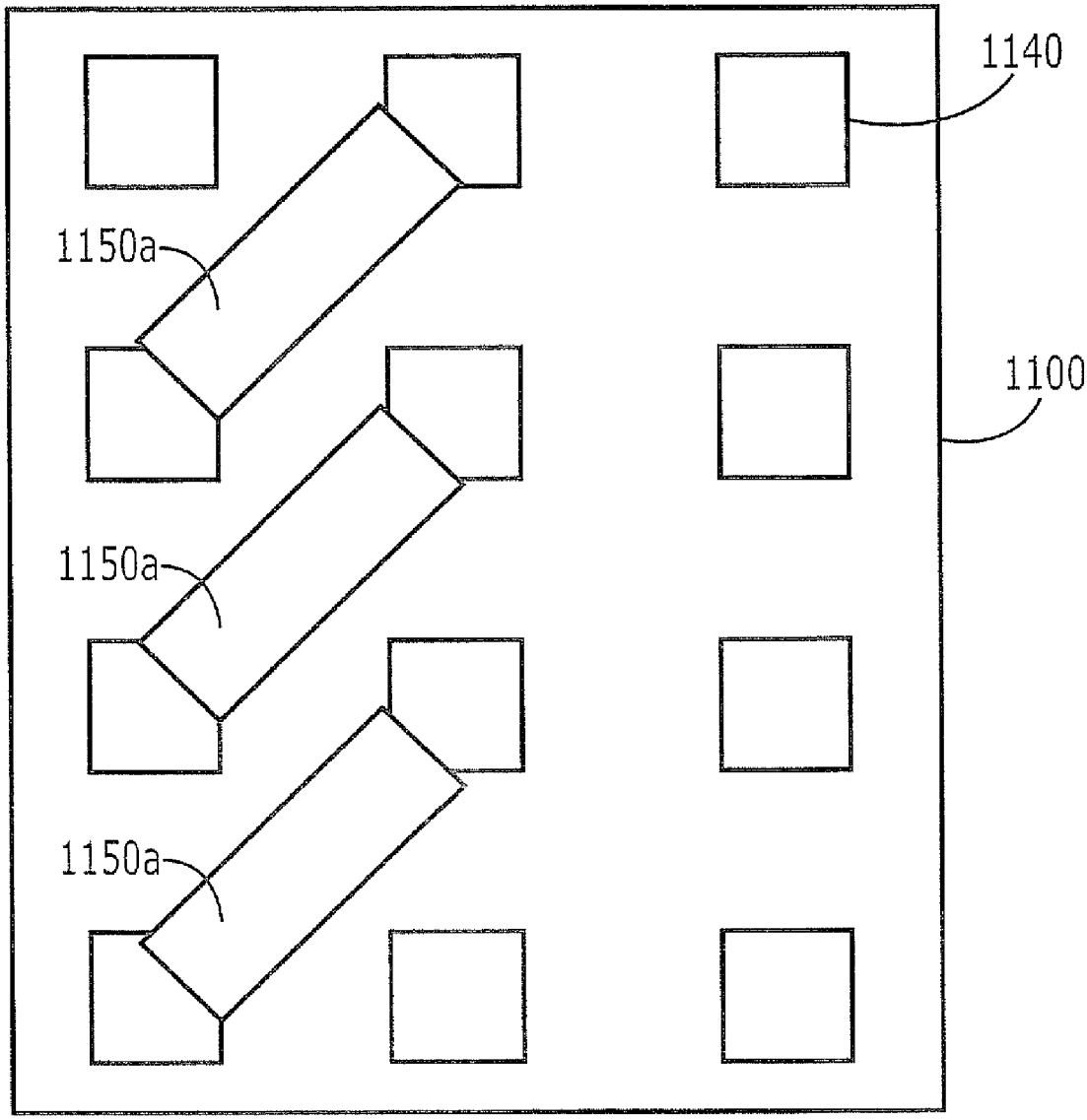
FIG. 11C is a bottom plane view of the antenna of FIG. 11A.

FIGS. 11A-11C show a spiral design implementation according to some embodiments of the present invention. As seen in FIGS. 11A-11C, a substrate, shown as a PCB 1100, includes a plurality of conductive vias 1140 extending therethrough from a front face (FIG. 11A) to a back face (FIG. 11B) of the PCB 1100. An antenna 1150 is formed by a plurality of front face antenna components 1150*b* and back face antenna components 1150*a* electrically connected between respective ones of the conductive vias 1150 and through the conductive vias 1050 to respective components on opposite faces of the PCB 1100.

While the examples of FIGS. 8A-11C all use a PCB design with conductive vias in place, and antenna configuration through selection of components and coupling of components through the vias, in some embodiments, a trace pattern may be formed on the faces of the PCB and the antenna may then be implemented by forming conductive vias through selected ones of a plurality of openings between ends of conductive traces on the respective faces of the PCB.

As seen in the illustrated embodiments, the total antenna element length may be reduced considerably compared to traditional meander line and straight line techniques. Radiation efficiency is indicated as highest for the helical antenna as predicted by the simulations. In some embodiments, a meander line and/or a helical GPS antenna can be tuned by placing 0402 or 0201 components (such as 0 ohm resistors) and using different layers on a PCB with the help of through via holes.

Figure 12:
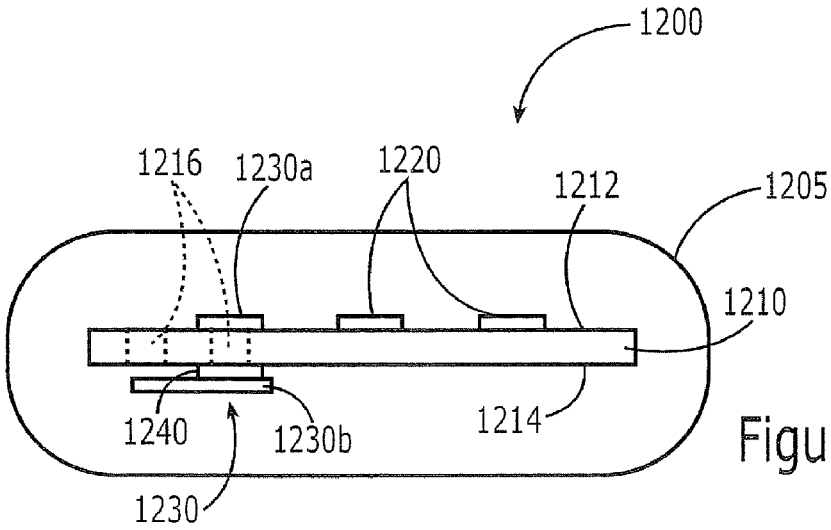
FIG. 12 is a schematic illustration of a mobile terminal according to some embodiments of the present invention.

Referring now to FIG. 12, a mobile terminal 1200 according to some embodiments of the present invention will be described. The mobile terminal includes a portable housing 1205 and a printed circuit board (PCB) 1210 mounted in the housing 1205. The PCB 1210 includes a plurality of through holes 1216 extending through the PCB 1210 between a front face 1212 and a back face 1214 of the PCB 1210. A wireless communication circuit 1220 is shown formed on the front face 1212, which circuit 1220 may be formed exclusively on the back face and/or on the front face and the back face of the PCB 1210. For example, the circuit 1220 may include a transceiver including a receiver and transmitter and/or a GPS receiver and/or a Bluetooth receiver in some embodiments.

A multi-plane antenna 1230 is located in the housing 1205 and operatively coupled to the receiver and/or transmitter of the wireless communication circuit 1220. The multi-plane antenna 1230 includes a first antenna component 1230*a* on the front face of the PCB 1205 and a second antenna component 1230*b* on the back face of the PCB 1210 and a conductive via 1240 extending through a selected one of the through holes 1216. The conductive via 1240 electrically connects the first antenna component 1230*a* and the second antenna component 1230*b* to define the multi-plane antenna 1230 on the PCB 1210. It will be understood that a plurality of antenna components may be provided on the front face of the PCB 1210 and on the back face of the PCB 1210 along with a plurality of conductive vias extending through selected ones of the through holes 1216 that electrically connect respective ones of the front and back face antenna components 1230*a*, 1230*b* to define the multi-plane antenna 1230 on the PCB 1210.

In some embodiments of the present invention, ones of the conductive vias extending through ones of the plurality of through holes are not associated with any of the antenna components. The multi-plane antenna may be, for example, a planar inverted F antenna (PIFA) and/or a meander antenna. For example, as discussed above, the antenna may be a 1.575 GHz GPS antenna. In addition, the antenna components 1230*a*, 1230*b* may be standard size components and a spacing of the through holes 1216 may correspond to the standard size. The antenna components 1230*a*, 1230*b* may be zero ohm resistors, capacitors and/or active components or the like.

Figure 13:
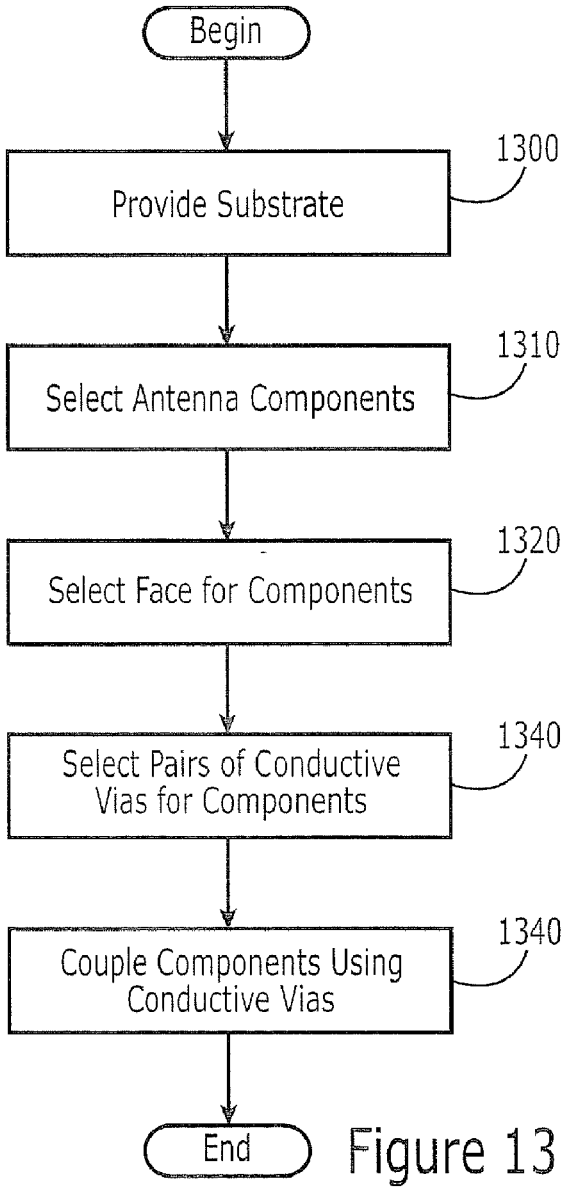
FIG. 13 is a flowchart illustrating a method of configuring a multi-plane antenna according to some embodiments of the present invention.

Methods for configuring a multi-plane antenna according to some embodiments of the present invention will now be described with reference to the flowchart illustration of FIG. 13. Operations for the embodiments of FIG. 13 begin with providing a substrate having a front face and a back face, a plurality of through holes extending through the substrate from the front face to the back face at selected locations on the substrate and conductive vias extending through the plurality of through holes (block 1300). Operations at block 1300 may include forming a plurality of through holes through the substrate at the selected locations on the substrate and forming the conductive vias through the plurality of through holes. The substrate may be, for example, a printed circuit board.

A plurality of antenna components for use in forming the multi-plane antenna are selected (block 1310). For example, the antenna components may be zero ohm resistors, capacitors, and/or active components such as switches. The antenna components may be standard size components and the spacing of the through holes may correspond to the standard size, such as 0201, 0402, 0603, 0804 or the like sized components.

Either the front face or the back face of the substrate is selected for mounting each of the selected plurality of antenna components (block 1320). For embodiments including components on multiple and distinct planes, a portion of the plurality of antenna components are associated with the front face while the remainder of the antenna components are associated with the back face at block 1320.

Pairs of the conductive vias are selected to be associated with respective ones of the antenna components (block 1330). The respective ones of the antenna components are electrically coupled between the corresponding pairs of conductive vias on the corresponding selected face of the substrate to form the multi-plane antenna (block 1340). The multi-plane antenna may be a planar inverted F antenna (PIFA), a monopole antenna and/or a dipole antenna. In some embodiments, the multi-plane antenna is a meander antenna and/or a spiral antenna. For example, the multi-plane antenna in some embodiments may be a 1.575 GHz GPS and/or a Bluetooth antenna. It will further be understood that a plurality of multi-plane antennas may be formed on a single substrate in some embodiments of the present invention.

In the drawings and specification, there have been disclosed embodiments of the invention and, although specific terms are employed, they are used in a generic and descriptive sense only and not for purposes of limitation, the scope of the invention being set forth in the following claims.

That which is claimed is:

1. A multi-plane antenna, comprising:

a substrate having a front face and a back face;

a plurality of through holes extending through the substrate between the front face and the back face of the substrate;

a plurality first antenna components on the front face of the substrate;

a plurality of second antenna components on the back face of the substrate; and a plurality of conductive vias extending through selected ones of the through holes that electrically connect respective ones of the first antenna components and the second antenna components to define the multi-plane antenna on the substrate, further comprising unused conductive vias extending through ones of the plurality of through holes not associated with any of the antenna components, which unused conductive vias are arranged for use with other multi-plane antenna configurations.

2. The antenna of claim 1, wherein the substrate comprises a printed circuit board (PCB).

3. The antenna of claim 1, wherein the unused conductive vias and the used conductive vias are mixed in a common grid arrangement.

4. The antenna of claim 1, wherein the multi-plane antenna comprises a planar inverted F antenna (PIFA), a monopole antenna and/or a dipole antenna.

5. The antenna of claim 4, wherein the multi-plane antenna comprises a PIFA.

6. The antenna of claim 1, wherein the multi-plane antenna comprises a meander antenna.

7. The antenna of claim 1, wherein the multi-plane antenna comprises a spiral antenna.

8. The antenna of claim 1, wherein the antenna components comprise standard size components and wherein a spacing of the through holes corresponds to the standard size.

9. The antenna of claim 1, wherein the standard size comprises 0201, 0402, 0603 and/or 0804.

10. The antenna of claim 1, wherein the antenna components comprise zero ohm resistors, capacitors and/or active components.

11. The antenna of claim 1, wherein the antenna comprises a 1.575 GHz GPS antenna and/or a Bluetooth antenna.

12. The antenna of claim 1, wherein the multi-plane antenna has a total antenna element length that is less than a total antenna length of a comparable performance single plane antenna.

13. The antenna of claim 1, further comprising a ground plane on the front or back face of the substrate that is positioned proximate the multi-plane antenna.

14. The method of claim 13, wherein selecting pairs of the conductive vias includes selecting other ones of the conductive vias as unused conductive vias extending through ones of the plurality of through holes not associated with any of the antenna components, which unused conductive vias are arranged for use with other multi-plane antenna configurations.

15. A mobile terminal including the multi-plane antenna of claim 1, wherein the mobile terminal further comprises a wireless communication circuit formed on the front and/or back face of the PCB.

16. A multi-plane antenna comprising:

a substrate having a front face and a back face;

a plurality of through holes extending through the substrate between the front face and the back face of the substrate;

a first antenna component on the front face of the substrate;

a second antenna component on the back face of the substrate; and a conductive via extending through a selected one of the through holes that electrically connects the first antenna component and the second antenna component to define the multi-plane antenna on the substrate;

wherein the substrate includes a surface defining a third plane and wherein the antenna further comprises:

a further plurality of through holes extending from the front and/or back face of the substrate to the third plane;

a third antenna component on the third plane;

a conductive via extending through a selected one of the further plurality of through holes that electrically connects the first and/or second antenna component to the third antenna component to define the multi-plane antenna on the substrate.

17. A multi-plane antenna, comprising:

a substrate having a front face and a back face;

a plurality of through holes extending through the substrate between the front face and the back face of the substrate;

a first antenna component on the front face of the substrate;

a second antenna component on the back face of the substrate; and a conductive via extending through a selected one of the through holes that electrically connects the first antenna component and the second antenna component to define the multi-plane antenna on the substrate;

wherein the first antenna component and/or the second antenna component comprise a trace pattern on the substrate and wherein the antenna further comprises additional trace patterns on the front and/or back face of the substrate extending between ones of the plurality of through holes that have no conductive vias extending therethrough and wherein the additional trace patterns are not used to define the multi-plane antenna but are configured to define other multi-plane antenna configurations.

18. A mobile terminal comprising:

a portable housing;

a printed circuit board (PCB) mounted in the housing, the PCB including a plurality of through holes extending through the PCB between a front face and a back face of the PCB;

a wireless communication circuit formed on the front face and/or the back face of the PCB; and a multi-plane antenna in the housing and operatively coupled to a receiver and/or transmitter of the wireless communication circuit, wherein the multi-plane antenna comprises:

a plurality first antenna components on the front face of the PCB;

a plurality of second antenna components on the back face of the PCB; and a plurality of conductive vias extending through selected ones of the through holes that electrically connect respective ones of the first antenna components and the second antenna components to define the multi-plane antenna on the PCB, wherein the antenna components comprise standard size components and wherein a spacing of the through holes corresponds to the standard size.

19. The mobile terminal of claim 18, further comprising unused conductive vias extending through ones of the plurality of through holes not associated with any of the antenna components, which unused conductive vias are arranged for use with other multi-plane antenna configurations.

20. The mobile terminal of claim 18, wherein the multi-plane antenna comprises a planar inverted F antenna (PIFA).

21. The mobile terminal of claim 20, wherein the antenna comprises a 1.575 GHz GPS antenna.

22. The mobile terminal of claim 18, wherein the antenna components comprise zero ohm resistors, capacitors and/or active components.

23. The mobile terminal of claim 18, wherein the multi-plane antenna comprises a spiral antenna.

24. A method for configuring a multi-plane antenna, comprising:

providing a substrate having a front face and a back face, a plurality of through holes extending through the substrate from the front face to the back face at selected locations on the substrate and conductive visa extending through the plurality of through holes;

selecting a plurality of antenna components, wherein the antenna components comprise standard size components and wherein a spacing of the through holes corresponds to the standard size;

selecting either the front face or the back face for mounting each of the selected plurality of antenna components;

selecting pairs of the conductive vias to be associated with respective ones of the antenna components; and electrically coupling the respective ones of the antenna components between the corresponding pairs of conductive vias on the corresponding selected face of the substrate to form the multi-plane antenna.

25. The method of claim 24, wherein providing the substrate comprises:

forming the plurality of through holes extending through the substrate from the front face to the back face at the selected locations on the substrate; and forming conductive vias extending through the plurality of through holes.

26. The method of claim 24, wherein selecting either the front face or the back face comprises:

selecting the front face for a portion of the plurality of antenna components; and selecting the back face for a remainder of the plurality of antenna components.

27. The method of claim 24, wherein the substrate comprises a printed circuit board (PCB).

28. The method of claim 27, wherein the multi-plane antenna comprises a 1.575 GHz GPS antenna and/or a Bluetooth antenna.

29. The method of claim 27, wherein the multi-plane antenna comprises a planar inverted F antenna (PIFA), a monopole antenna and/or a dipole antenna.

30. The method of claim 27, wherein the multi-plane antenna comprises a meander antenna and/or a spiral antenna.

* * * * *

UNITED STATES PATENT AND TRADEMARK OFFICE

CERTIFICATE OF CORRECTION

PATENT NO. : 7,724,193 B2
APPLICATION NO. : 11/840454
DATED : May 25, 2010
INVENTOR(S) : Soora et al.

It is certified that error appears in the above-identified patent and that said Letters Patent is hereby corrected as shown below:

Column 12, Claim 24, Line 2: Please correct "visa" to read -- vias --

Signed and Sealed this

Ninth Day of November, 2010

David J. Kappos

David J. Kappos
*Director of the United States Patent and Trademark Office*